US012552505B2

(12) United States Patent
Murayama et al.

(10) Patent No.: US 12,552,505 B2
(45) Date of Patent: Feb. 17, 2026

(54) REVERSE BUCKET FOR JET PROPULSION DEVICE, JET PROPULSION DEVICE FOR MARINE VESSEL, AND MARINE VESSEL

(71) Applicant: YAMAHA HATSUDOKI KABUSHIKI KAISHA, Iwata (JP)

(72) Inventors: Takuya Murayama, Shizuoka (JP); Hideyoshi Sato, Shizuoka (JP); Masaru Tamaki, Shizuoka (JP); Isao Sugano, Shizuoka (JP); Kiyoe Kawauchi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 469 days.

(21) Appl. No.: 18/136,375

(22) Filed: Apr. 19, 2023

(65) Prior Publication Data

US 2023/0339586 A1 Oct. 26, 2023

(30) Foreign Application Priority Data

Apr. 22, 2022 (JP) ..... 2022-070898

(51) Int. Cl.
*B63H 11/11* (2006.01)

(52) U.S. Cl.
CPC ..... *B63H 11/11* (2013.01)

(58) Field of Classification Search
CPC ..... B63H 11/11; B63H 11/113
See application file for complete search history.

(56) References Cited

U.S. PATENT DOCUMENTS

| | | | | |
|---|---|---|---|---|
| 6,183,318 | B1 | 2/2001 | Tsumiyama et al. | |
| 2003/0073357 | A1 | 4/2003 | Fuse et al. | |
| 2008/0189001 | A1* | 8/2008 | Morvillo | B63H 21/213 440/87 |
| 2014/0096506 | A1* | 4/2014 | Kaneko | B63H 11/11 60/221 |
| 2015/0086373 | A1 | 3/2015 | Kaneko et al. | |
| 2020/0047859 | A1* | 2/2020 | Kinomoto | B63B 34/10 |

FOREIGN PATENT DOCUMENTS

| | | | |
|---|---|---|---|
| JP | 3358718 | B2 | 12/2002 |
| JP | 3974362 | B2 | 9/2007 |
| JP | 5816238 | B2 | 11/2015 |
| WO | 2009/134153 | A1 | 11/2009 |

* cited by examiner

*Primary Examiner* — Andrew Polay
(74) *Attorney, Agent, or Firm* — Keating & Bennett, LLP

(57) ABSTRACT

A reverse bucket for a jet propulsion device includes a vertical ridge line that faces a discharge opening of a deflector to make a marine vessel move backward, a first inlet region and a second inlet region separated by the ridge line to receive water discharged from the discharge opening, first and second outlet regions to discharge the water received by the first and second inlet regions to the outside, and first and second guide regions to guide the water received by the first and second inlet regions to the first and second outlet regions. The first inlet region, the first guide region, and the first outlet region define a first recess portion including a first opening that faces the discharge opening. The second inlet region, the second guide region, and the second outlet region define a second recess portion including a second opening that faces the discharge opening.

16 Claims, 8 Drawing Sheets

REVERSE BUCKET FOR JET PROPULSION DEVICE, JET PROPULSION DEVICE FOR MARINE VESSEL, AND MARINE VESSEL

CROSS REFERENCE TO RELATED APPLICATIONS

This application claims the benefit of priority to Japanese Patent Application No. 2022-070898, filed on Apr. 22, 2022. The entire contents of this application are hereby incorporated herein by reference.

BACKGROUND OF THE INVENTION

1. Field of the Invention

The present invention relates to a reverse bucket for a jet propulsion device, a jet propulsion device for a marine vessel, and a marine vessel.

2. Description of the Related Art

Among various types of jet propulsion devices applied to marine vessels, there is a type of known jet propulsion device that includes a deflector, which changes a direction of water discharged from a nozzle to the left or the right, and a reverse bucket, which is positioned behind the deflector when moving the marine vessel backward so as to change the direction of the water current. For example, in Japanese Patent No. 3358718, Japanese Patent No. 5816238, Japanese Patent No. 3974362, and WO 2009/134153, a reverse bucket discharges the water received from a deflector leftward, rightward, downward, or forward through a cylindrical portion.

However, in order to enhance the backward moving performance of the marine vessel, it is important that the reverse bucket efficiently guides and discharges the water received from the deflector. For example, it is not desirable to have a configuration in which the water current is stagnant or the water current is forcibly guided. In Japanese Patent No. 3358718, Japanese Patent No. 5816238, Japanese Patent No. 3974362, and WO 2009/134153, although the water received from the deflector passes through the cylindrical portion, this is not always advantageous for efficiently guiding and discharging the water. Therefore, there is room for improvement in terms of enhancing the backward moving performance of the marine vessel.

SUMMARY OF THE INVENTION

Preferred embodiments of the present invention provide reverse buckets for jet propulsion devices, jet propulsion devices for marine vessels, and marine vessels that are each able to enhance the backward moving performance of a marine vessel.

According to a preferred embodiment of the present invention, a reverse bucket for a jet propulsion device includes a vertical ridge line that faces a discharge opening of a deflector in a backward moving posture to make a marine vessel move backward, a first inlet region and a second inlet region separated by the ridge line so that the first inlet region is positioned on a left side of the ridge line and the second inlet region is positioned on a right side of the ridge line and face the discharge opening in the backward moving posture to receive water discharged from the discharge opening, a first outlet region to discharge the water received by the first inlet region to outside of the jet propulsion device, a second outlet region to discharge the water received by the second inlet region to the outside of the jet propulsion device, a first guide region to guide the water received by the first inlet region to the first outlet region, and a second guide region to guide the water received by the second inlet region to the second outlet region. The first inlet region, the first guide region, and the first outlet region define a first recess portion. The second inlet region, the second guide region, and the second outlet region define a second recess portion. The first recess portion includes a first opening that opens a side of the first recess portion facing the discharge opening of the deflector in the backward moving posture. The second recess portion includes a second opening that opens a side of the second recess portion facing the discharge opening of the deflector in the backward moving posture.

According to another preferred embodiment of the present invention, a reverse bucket for a jet propulsion device includes an inlet region facing a discharge opening of a deflector in a backward moving posture to make a marine vessel move backward to receive water discharged from the discharge opening, an outlet region to discharge the water received by the inlet region to outside of the jet propulsion device, and a guide region to guide the water received by the inlet region to the outlet region. The inlet region, the guide region, and the outlet region define a recess portion including a continuous opening.

According to another preferred embodiment of the present invention, a jet propulsion device for a marine vessel includes a deflector that is rotatable leftward or rightward, and a reverse bucket. The reverse bucket includes a vertical ridge line that faces a discharge opening of the deflector in a backward moving posture to make the marine vessel move backward, a first inlet region and a second inlet region separated by the ridge line so that the first inlet region is positioned on a left side of the ridge line and the second inlet region is positioned on a right side of the ridge line, and face the discharge opening in the backward moving posture to receive water discharged from the discharge opening, a first outlet region to discharge the water received by the first inlet region to outside of the jet propulsion device, a second outlet region to discharge the water received by the second inlet region to the outside of the jet propulsion device, a first guide region to guide the water received by the first inlet region to the first outlet region, and a second guide region to guide the water received by the second inlet region to the second outlet region. The first inlet region, the first guide region, and the first outlet region define a first recess portion. The second inlet region, the second guide region, and the second outlet region define a second recess portion. The first recess portion includes a first opening that opens a side of the first recess portion facing the discharge opening of the deflector in the backward moving posture. The second recess portion includes a second opening that opens a side of the second recess portion facing the discharge opening of the deflector in the backward moving posture.

According to another preferred embodiment of the present invention, a marine vessel includes at least one jet propulsion device. The jet propulsion device includes a deflector that is rotatable leftward or rightward, and a reverse bucket. The reverse bucket includes a vertical ridge line that faces a discharge opening of the deflector in a backward moving posture to make the marine vessel move backward, a first inlet region and a second inlet region separated by the ridge line so that the first inlet region is positioned on a left side of the ridge line and the second inlet region is positioned on a right side of the ridge line, and face the discharge opening in the backward moving posture to receive water discharged from the discharge opening, a first outlet region to discharge the water received by the first inlet region to outside of the jet propulsion device, a second outlet region to discharge the water received by the second inlet region to the outside of the jet propulsion device, a first guide region to guide the water received by the first inlet region to the first outlet region, and a second guide region to guide the water received by the second inlet region to the second outlet region. The first inlet region, the first guide region, and the first outlet region define a first recess portion. The second inlet region, the second guide region, and the second outlet region define a second recess portion. The first recess portion includes a first opening that opens a side of the first recess portion facing the discharge opening of the deflector in the backward moving posture. The second recess portion includes a second opening that opens a side of the second recess portion facing the discharge opening of the deflector in the backward moving posture.

According to preferred embodiments of the present invention, in the backward moving posture, the water discharged from the discharge opening of the deflector is divided to the left and the right by the ridge line and is received in the first inlet region and the second inlet region, respectively. The water received by the first inlet region and the water received by the second inlet region are guided to the first outlet region and the second outlet region by the first guide region and the second guide region, respectively, and are discharged to the outside from the first outlet region and the second outlet region, respectively. Since the first inlet region, the first guide region, and the first outlet region define the first recess portion including the first opening, and the second inlet region, the second guide region, and the second outlet region define the second recess portion including the second opening, it is possible to efficiently discharge the received water. As a result, it is possible to enhance the backward moving performance of the marine vessel.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
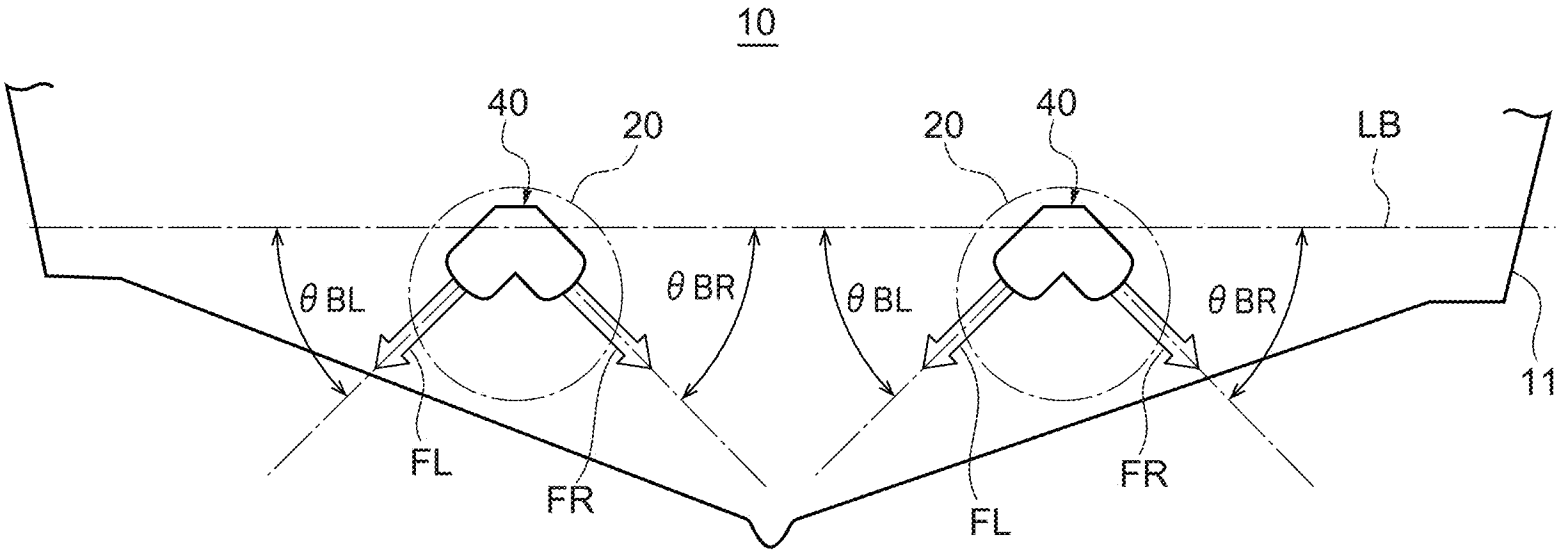
FIG. 1 is a schematic rear view of a marine vessel including at least one jet propulsion device for a marine vessel to which a reverse bucket according to a first preferred embodiment of the present invention is applied.

First, a first preferred embodiment of the present invention will be described. FIG. 1 is a schematic rear view of a marine vessel 10 including at least one jet propulsion device for a marine vessel to which a reverse bucket according to the first preferred embodiment of the present invention is applied.

As shown in FIG. 1, the marine vessel 10 is, for example, a jet propulsion boat, and is such a marine vessel called a jet boat or a sports boat. The marine vessel 10 includes a hull 11 and jet propulsion devices 20. The two jet propulsion devices 20, which are marine vessel propulsion devices, are provided and located side by side on the left and the right of the stern. It should be noted that the number of the jet propulsion devices 20 is not limited to two, and may be one or three or more.

Although not shown in FIG. 1, the hull 11 is provided with engines that drive the jet propulsion devices 20. In addition, a marine vessel maneuvering seat (not shown) is located on the deck of the hull 11, and a steering device (not shown) and a remote control unit (not shown) are located near the marine vessel maneuvering seat. The jet propulsion device 20 is driven by the corresponding engine, and generates a propulsive force to move the hull 11 by sucking in water around the hull 11 and jetting it out.

Figure 2:
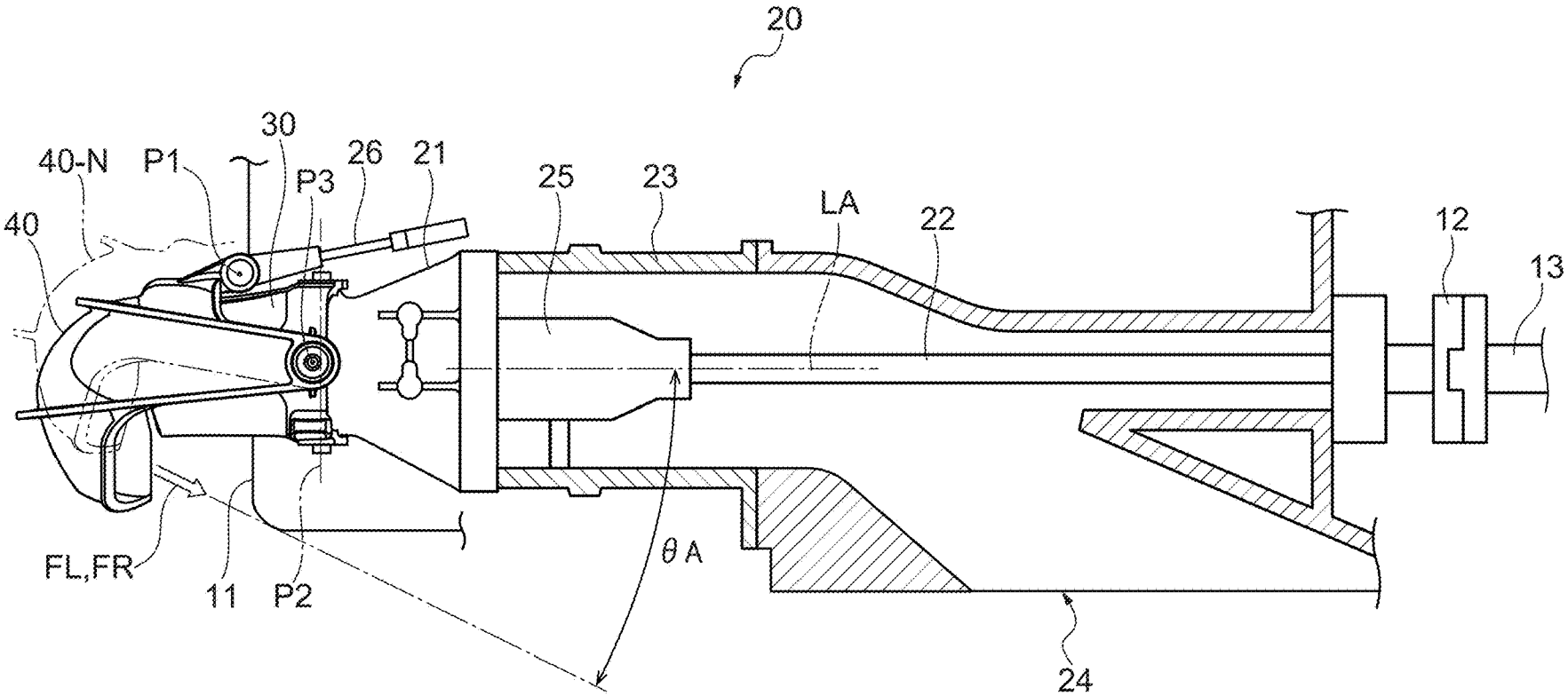
FIG. 2 is a schematic side view that shows a configuration of the jet propulsion device for the marine vessel to which the reverse bucket according to the first preferred embodiment of the present invention is applied.

FIG. 2 is a schematic side view that shows a configuration of the jet propulsion device 20, a portion of which is shown in cross section. Since the configurations of the two jet propulsion devices 20 are common, one jet propulsion device 20 will be described.

The jet propulsion device 20 includes a reverse bucket 40. The reverse bucket 40 is switchable between a forward moving position (a forward position), a backward moving position (a reverse position), and a neutral position. FIG. 1 and FIG. 2 show a state in "a backward moving posture" in which the reverse bucket 40 is in the backward moving position. It should be noted that the neutral position of the reverse bucket 40 is indicated by a reference numeral 40-N in FIG. 2.

As shown in FIG. 2, the jet propulsion device 20 includes an impeller housing 23, an impeller shaft 22, an impeller 25, a nozzle 21, a deflector 30, and the reverse bucket 40. The impeller shaft 22 extends in a front-rear direction of the hull 11. A front portion of the impeller shaft 22 is connected to an output shaft 13 of the corresponding engine via a coupling 12. A rear portion of the impeller shaft 22 is positioned inside the impeller housing 23. The impeller housing 23 is located behind a water suction portion 24. The nozzle 21 is located behind the impeller housing 23.

The impeller 25 is attached to the rear portion of the impeller shaft 22. The impeller 25 is located inside the impeller housing 23. The impeller 25 rotates together with the impeller shaft 22 and sucks in the water from the water suction portion 24. The impeller 25 jets the sucked in water rearward from the nozzle 21.

Figure 3:
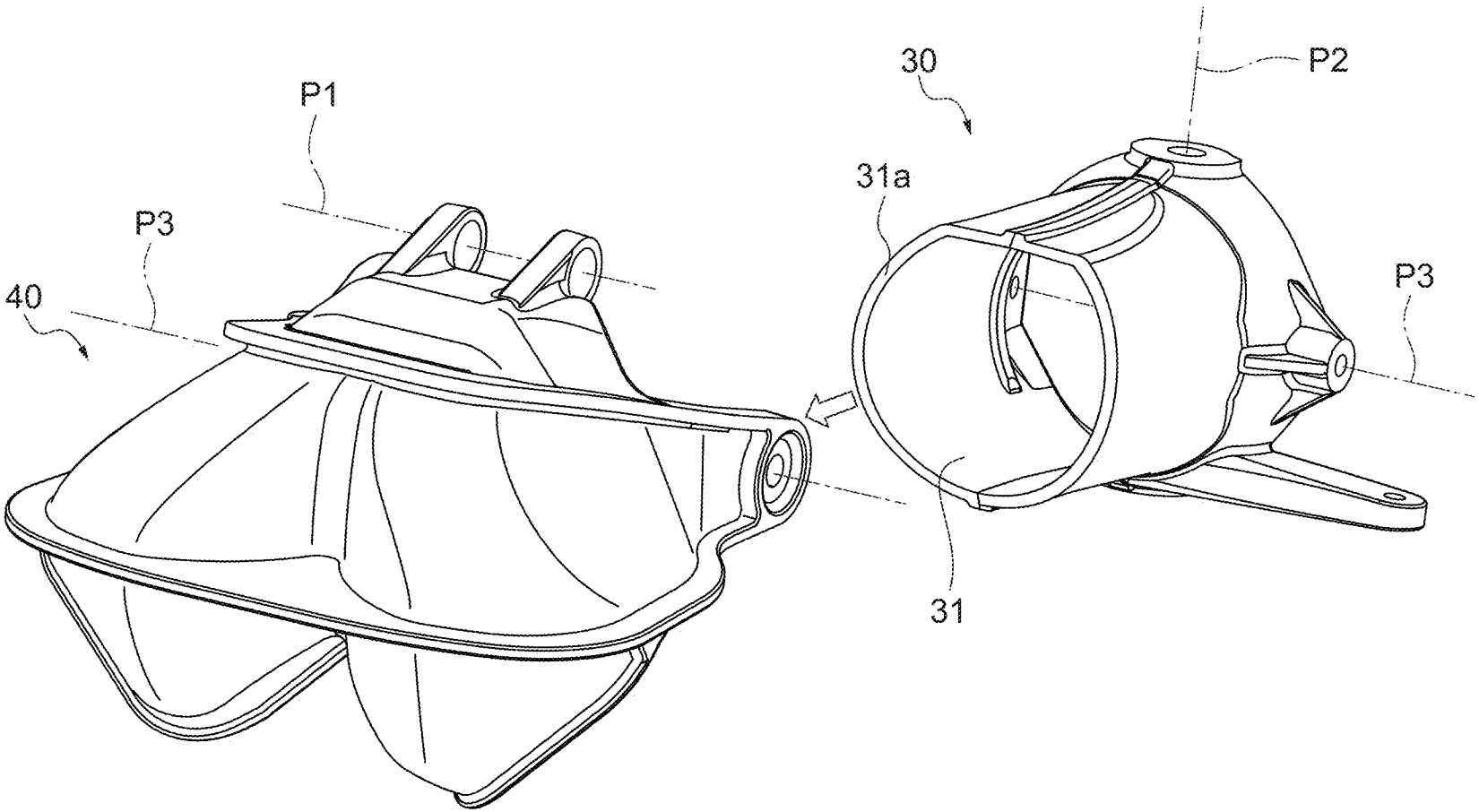
FIG. 3 is an exploded perspective view of the reverse bucket in a backward moving posture and a deflector.
Figure 4:
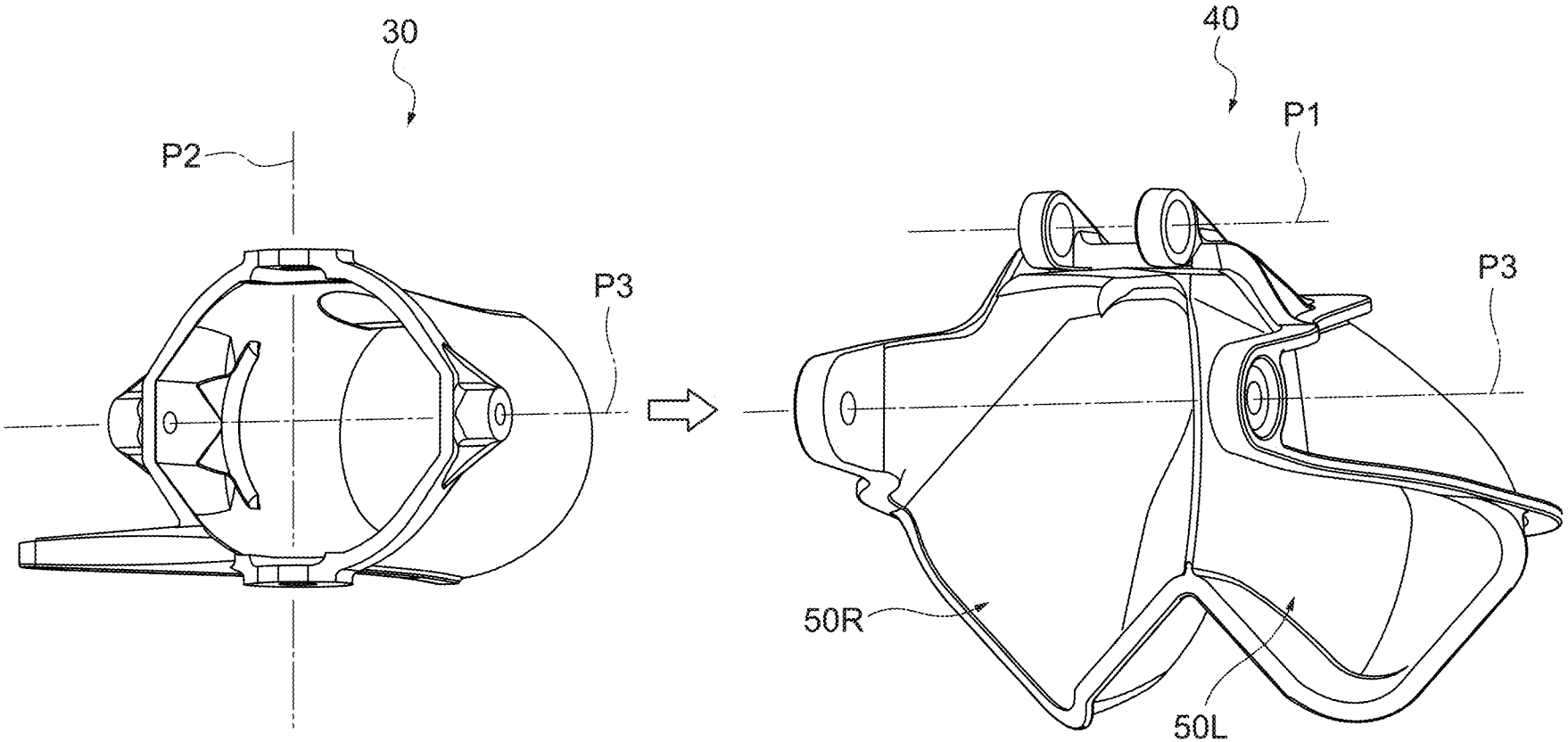
FIG. 4 is an exploded perspective view of the reverse bucket in the backward moving posture and the deflector.
Figure 5:
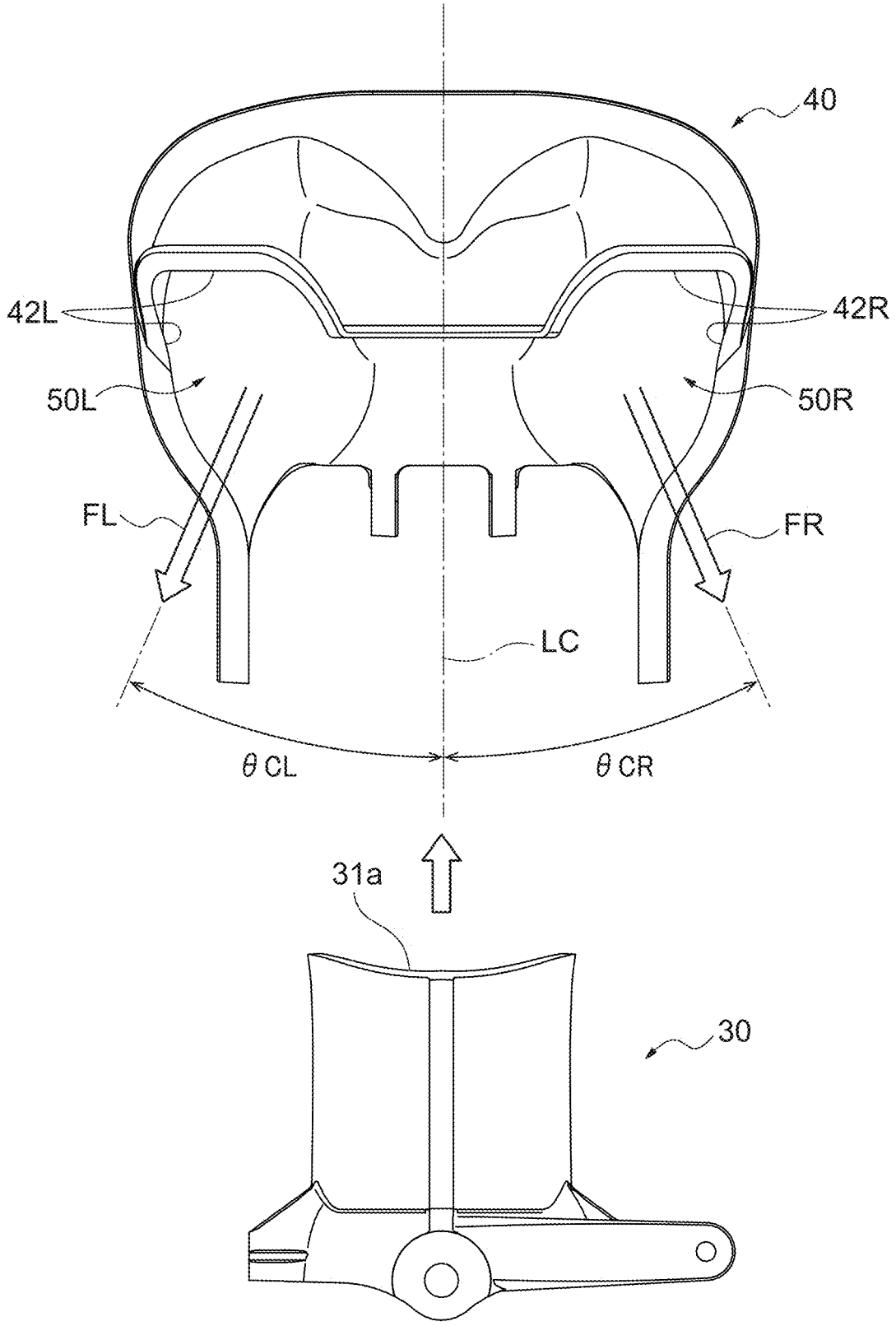
FIG. 5 is an exploded bottom view of the reverse bucket in the backward moving posture and the deflector.

FIG. 3 and FIG. 4 are exploded perspective views of the reverse bucket 40 in the backward moving posture and the deflector 30. FIG. 5 is an exploded bottom view of the reverse bucket 40 in the backward moving posture and the deflector 30.

As shown in FIG. 2, the deflector 30 is located behind the nozzle 21. The deflector 30 is connected to the nozzle 21 so as to be freely rotatable around a rotation center P2 (also see FIG. 3 and FIG. 4). A shaft line direction of the rotation center P2 is parallel or substantially parallel to a vertical direction. The deflector 30 changes a jetting direction of the water from the nozzle 21 to the left or the right. Therefore, by changing the direction of the deflector 30 to the left or the right, a traveling direction (a moving direction) of the marine vessel 10 is changed to the left or the right.

As shown in FIG. 2, the reverse bucket 40 is connected to a shift rod 26 so as to be freely rotatable around a rotation center P1 (also see FIG. 3 and FIG. 4). Accordingly, the position of the reverse bucket 40 is switched between the forward moving position, the backward moving position, and the neutral position in response to the operation of a shift operating element (not shown).

In addition, the reverse bucket 40 is connected to the deflector 30 so as to be freely rotatable around a rotation center P3 (also see FIG. 3 and FIG. 4). Therefore, the reverse bucket 40 rotates together with the deflector 30 leftward or rightward, and rocks or rotates vertically relative to the deflector 30. A shaft line direction of the rotation center P1 and a shaft line direction of the rotation center P3 are parallel or substantially parallel to each other, and are perpendicular or substantially perpendicular to the shaft line direction of the rotation center P2.

The deflector 30 has a cylindrical or substantially cylindrical shape, and discharges the water jetted from the nozzle 21 from a discharge opening 31 (see FIG. 3). The details of the configuration of the reverse bucket 40 and a function of changing the direction of the discharged water from the deflector 30 by the reverse bucket 40 will be described below.

To outline here, in a state in which the reverse bucket 40 is in the forward moving position, since the reverse bucket 40 does not cover the deflector 30, the discharged water from the deflector 30 directly becomes a jet flow backward. As a result, the marine vessel 10 moves forward.

In the state in which the reverse bucket 40 is in the backward moving position, since the reverse bucket 40 covers the deflector 30 from behind, the discharged water from the deflector 30 is converted by the reverse bucket 40 into a jet flow including a forward component. As a result, the marine vessel 10 moves backward.

The neutral position of the reverse bucket 40 is a position between the forward moving position and the backward moving position in a rotation direction around the rotation center P1. In the neutral position, since the reverse bucket 40 covers a portion of the deflector 30, the discharged water from the deflector 30 is converted by the reverse bucket 40 into a jet flow including some forward and backward components. Therefore, in the neutral position, the reverse bucket 40 reduces the propulsive force that makes the marine vessel 10 move forward or backward. As a result, either the marine vessel 10 is slowed down or the marine vessel 10 is held at a stopped position.

Hereinafter, jet flows discharged from the reverse bucket 40 to the outside through the deflector 30 are referred to as a jet flow FL and a jet flow FR. As shown in FIG. 1, the jet flow FL and the jet flow FR are the jet flows discharged from the reverse bucket 40 in the backward moving posture, the jet flow FL is a jet flow including a leftward component, and the jet flow FR is a jet flow including a rightward component.

Figure 6:
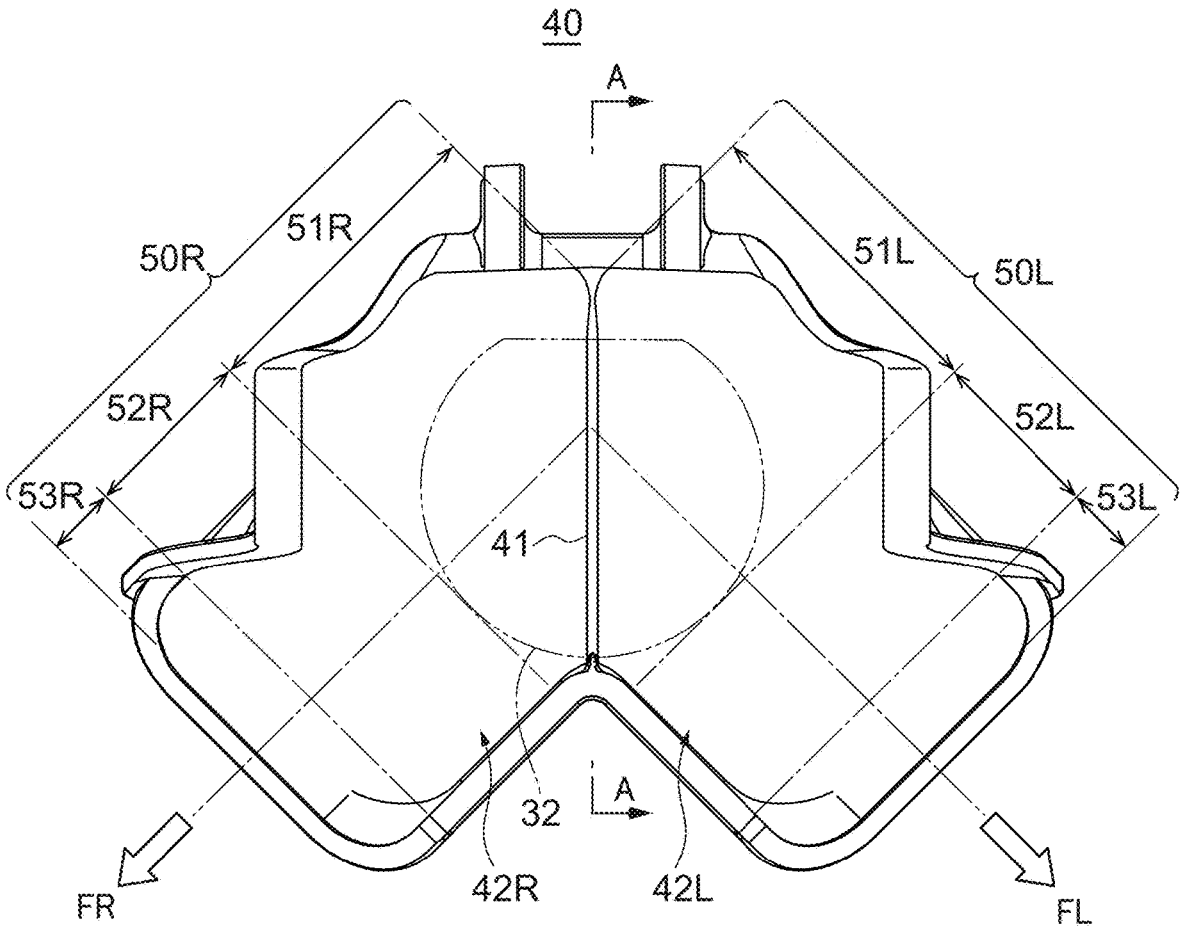
FIG. 6 is a front view of the reverse bucket in the backward moving posture.

FIG. 6 is a front view of the reverse bucket 40 in the backward moving posture. Strictly speaking, FIG. 6 is a front view of the reverse bucket 40, which is in a posture in which the marine vessel 10 is moved straight backward (in a state in which the discharge opening 31 of the deflector 30 faces straight rearward) among the backward moving postures. In other words, in FIG. 6, the reverse bucket 40 in the backward moving posture is viewed from a direction which is parallel to a center line of the cylindrical shape of the deflector 30 and in which the nozzle 21 is located.

In the backward moving posture, a tip 31*a* (see FIG. 3) of the discharge opening 31 of the deflector 30 faces the reverse bucket 40. In FIG. 6, a discharge range 32, in which the water is discharged from the discharge opening 31, corresponds to a partially circular shape of an inner diameter of the discharge opening 31 of the deflector 30.

The reverse bucket 40 includes a ridge line 41, a first recess portion 50L, and a second recess portion 50R. The first recess portion 50L and the second recess portion 50R are separated by the ridge line 41 so that the first recess portion 50L is positioned on the left and the second recess portion 50R is positioned on the right. The first recess portion 50L includes a first opening 42L, and the second recess portion 50R includes a second opening 42R. A first inlet region 51L, a first guide region 52L, and a first outlet region 53L define the first recess portion 50L. A second inlet region 51R, a second guide region 52R, and a second outlet region 53R define the second recess portion 50R. The first recess portion 50L has a substantially groove shape in which a side facing the discharge opening 31 of the deflector 30 is open in the backward moving posture. An open portion of the first recess portion 50L corresponds to the first opening 42L. The first opening 42L exists across or extends along the first inlet region 51L, the first guide region 52L, and the first outlet region 53L that constitute the first recess portion 50L. The second recess portion 50R has a substantially groove shape in which a side facing the discharge opening 31 of the deflector 30 is open in the backward moving posture. An open portion of the second recess portion 50R corresponds to the second opening 42R. The second opening 42R exists across or extends along the second inlet region 51R, the second guide region 52R, and the second outlet region 53R that constitute the second recess portion 50R.

In the backward moving posture, a portion of the first opening 42L is visible from the left, and a portion of the second opening 42R is visible from the right. In addition, a portion of the first opening 42L is visible from below and from the front, and a portion of the second opening 42R is visible from below and from the front.

In the backward moving posture, the ridge line 41 extends vertically and faces the discharge opening 31. The first inlet region 51L and the second inlet region 51R are separated by the ridge line 41 so that the first inlet region 51L is positioned on the left and the second inlet region 51R is positioned on the right. The first inlet region 51L and the second inlet region 51R are main regions that include regions facing the discharge opening 31 in the backward moving posture and receive the discharged water from the discharge opening 31. The first guide region 52L is a main region that guides the water received by the first inlet region 51L to the first outlet region 53L. The second guide region 52R is a main region that guides the water received by the second inlet region 51R to the second outlet region 53R.

The first outlet region 53L is a main region that discharges the water guided by the first guide region 52L to the outside. The second outlet region 53R is a main region that discharges the water guided by the second guide region 52R to the outside. In the backward moving posture, the water is discharged from the first outlet region 53L to the lower left front (the jet flow FL), and the water is discharged from the second outlet region 53R to the lower right front (the jet flow FR). As a result, it is possible to make the marine vessel 10 move backward. Detailed angles of the jet flow FL and the jet flow FR will be described below.

In the first preferred embodiment of the present invention, an entire region of the first recess portion 50L defines a flow path, and an entire region of the second recess portion 50R defines a flow path. That is, the first inlet region 51L, the first guide region 52L, and the first outlet region 53L define the entire region of the first recess portion 50L; and the second inlet region 51R, the second guide region 52R, and the second outlet region 53R define the entire region of the second recess portion 50R. Since these flow paths are open without having a cylindrical portion, they are advantageous for efficiently guiding and discharging the water. Therefore, it is possible to enhance the backward moving performance of the marine vessel 10.

In addition, the entire region of the first recess portion 50L has a continuous concave curved surface, and the entire region of the second recess portion 50R has a continuous concave curved surface. If there is a step or a discontinuous portion in a portion of the flow path, the water current will be disturbed and separation will easily occur, and the water will not flow smoothly. However, in the first preferred embodiment of the present invention, since the continuous concave curved surface receives the water, guides it to the outlet, and discharges it, it is possible to efficiently receive and discharge the water. In particular, the water current becomes smoother, and the efficiency of changing the direction of the water current increases.

Figure 7:
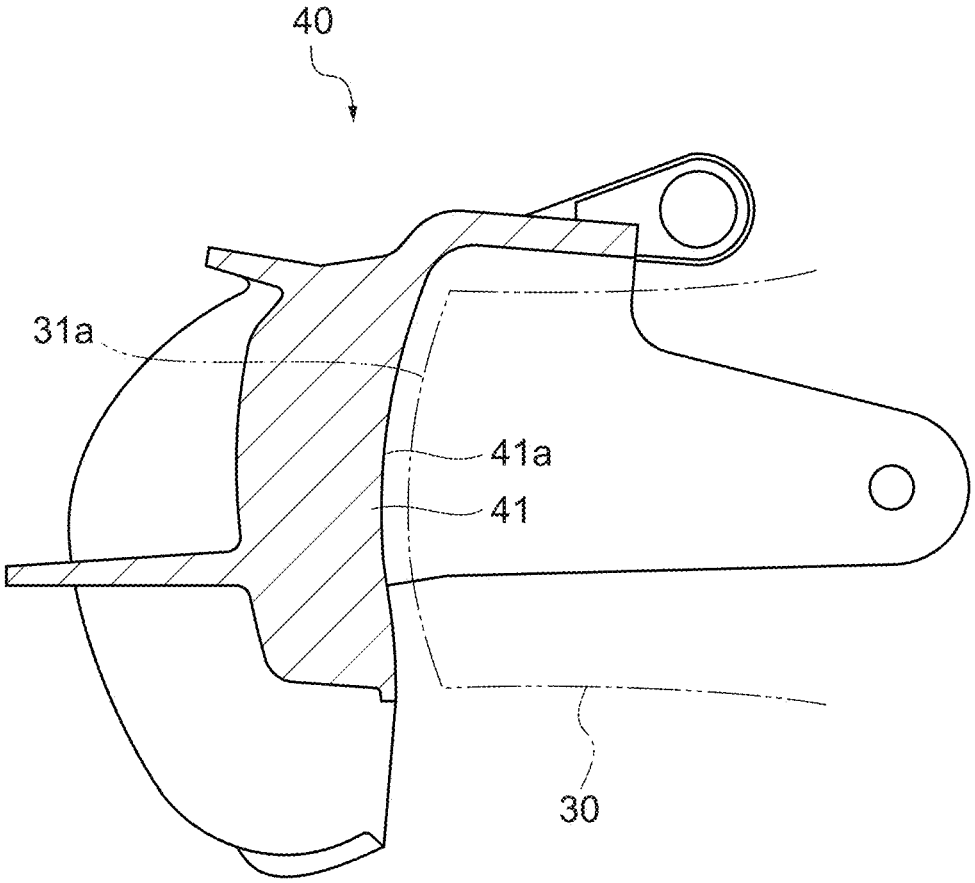
FIG. 7 is a cross sectional view along a line A-A in FIG. 6.

FIG. 7 is a cross sectional view along a line A-A in FIG. 6. In the backward moving posture, the ridge line 41 is curved so as to be recessed backward when viewed from the side. On the other hand, in the backward moving posture in which the marine vessel 10 is moved straight backward, the tip 31*a* of the discharge opening 31 is curved so as to protrude backward when viewed from the side. The tip 31*a* and a tip 41*a* of the ridge line 41 face each other with a substantially constant small clearance maintained therebetween. According to these configurations, the water discharged from the discharge opening 31 is efficiently divided by the ridge line 41 into the first inlet region 51L and the second inlet region 51R.

Next, a direction of the jet flow FL and a direction of the jet flow FR (a discharge direction of the water from the first outlet region 53L and a discharge direction of the water from the second outlet region 53R) will be described. The direction of the jet flow FL and the direction of the jet flow FR are hereinafter defined by the backward moving posture shown in FIG. 6 (that is, defined by the posture in which the reverse bucket 40 is in the backward moving position and the discharge opening 31 of the deflector 30 faces straight rearward). In addition, a posture in which both a pitch angle of the marine vessel 10 and a roll angle of the marine vessel 10 are zero is taken as a reference.

First, as shown in FIG. 1, in the backward moving posture, both the direction of the jet flow FL and the direction of the jet flow FR are within an angle range of about 30 degrees to about 85 degrees below a virtual plane LB parallel to a horizontal plane when viewed from the rear. That is, below the virtual plane LB, both an angle θBL formed by the direction of the jet flow FL and the virtual plane LB and an angle θBR formed by the direction of the jet flow FR and the virtual plane LB are about 30 degrees or more and are about 85 degrees or less.

In addition, as shown in FIG. 2, in the backward moving posture, both the direction of the jet flow FL and the direction of the jet flow FR are within an angle range of about 15 degrees to about 45 degrees below a virtual plane LA parallel to the horizontal plane when viewed from the side. That is, below the virtual plane LA, both an angle θAL formed by the direction of the jet flow FL and the virtual plane LA and an angle θAR formed by the direction of the jet flow FR and the virtual plane LA are about 15 degrees or more and are about 45 degrees or less.

In addition, as shown in FIG. 5, in the backward moving posture, both the direction of the jet flow FL and the direction of the jet flow FR are within an angle range of about 15 degrees to about 45 degrees in front of a virtual straight line LC in the front-rear direction when viewed from above or below. That is, in front of the virtual straight line LC, both an angle θCL formed by the direction of the jet flow FL and the virtual straight line LC and an angle θCR formed by the direction of the jet flow FR and the virtual straight line LC are about 15 degrees or more and are about 45 degrees or less.

By designing the direction of the jet flow FL and the direction of the jet flow FR to become within the above angle ranges, the discharged jet flows are less likely to hit the hull 11 and are less likely to be sucked in again from the water suction portion 24. As a result, it is possible to enhance the backward moving efficiency.

More preferably, both the direction of the jet flow FL and the direction of the jet flow FR may be within an angle range of about 40 degrees to about 50 degrees below the virtual plane LB when viewed from the rear. Furthermore, more preferably, both the direction of the jet flow FL and the direction of the jet flow FR may be within an angle range of about 25 degrees to about 35 degrees below the virtual plane LA. Moreover, more preferably, both the direction of the jet flow FL and the direction of the jet flow FR may be within an angle range of about 25 degrees to about 35 degrees in front of the virtual straight line LC when viewed from above or below. Either of these makes it easier to adapt to the bottom shapes of various kinds of hulls on which the jet propulsion device 20 is mounted. This is advantageous for enhancing the backward moving efficiency in various kinds of hulls.

According to the first preferred embodiment of the present invention, in the reverse bucket 40, the first inlet region 51L, the first guide region 52L, and the first outlet region 53L define the first recess portion 50L. In addition, the second inlet region 51R, the second guide region 52R, and the second outlet region 53R define the second recess portion 50R. In addition, the first recess portion 50L has the substantially groove shape, and includes the first opening 42L which exists across or extends along the first inlet region 51L, the first guide region 52L, and the first outlet region 53L that constitute the first recess portion 50L. The second recess portion 50R has the substantially groove shape, and includes the second opening 42R which exists across or extends along the second inlet region 51R, the second guide region 52R, and the second outlet region 53R that constitute the second recess portion 50R. Therefore, since the reverse bucket 40 does not include the conventional configuration in which the water passes through a cylindrical portion, nor does it include a configuration in which the water current is stagnant or the water current is forcibly guided, the reverse bucket 40 is advantageous for efficiently guiding and discharging the water. As a result, since the reverse bucket 40 is able to efficiently guide and discharge the water received from the discharge opening 31 of the deflector 30, it is possible to enhance the backward moving performance of the marine vessel 10. In addition, since the first recess portion 50L and the second recess portion 50R are open, manufacturing of the reverse bucket 40 is easy.

It should be noted that by providing one or more pairs of jet propulsion devices 20 on the left and right sides, it is also possible to improve the lateral movement performance of the marine vessel 10.

In addition, in the backward moving posture, since the water is discharged from the first outlet region 53L to the lower left front and the water is discharged from the second outlet region 53R to the lower right front, it is possible to further enhance the backward moving performance of the marine vessel 10.

In addition, by providing the entire region of the first recess portion 50L and the entire region of the second recess portion 50R with the continuous concave curved surfaces, it is possible to more efficiently receive and discharge the water. It should be noted that it is not essential that the entire region has a continuous concave curved surface. For example, if there are no steps or discontinuous portions, even in the case that there is a flat surface in a portion of the entire region of the first recess portion 50L and in a portion of the entire region of the second recess portion 50R, there is an effect of improving the backward moving performance of the marine vessel 10.

In addition, with regard to the direction of the jet flow FL and the direction of the jet flow FR in the backward moving posture, the angle θBL and the angle θBR are about 30 degrees or more and are about 85 degrees or less (see FIG. 1), the angle θAL and the angle θAR are about 15 degrees or more and are about 45 degrees or less (see FIG. 2), and the angle θCL and the angle θCR are about 15 degrees or more and are about 45 degrees or less (see FIG. 5). Such a design makes it difficult for the discharged jet flows to hit the hull 11 and makes it difficult for the discharged jet flows to be sucked in again from the water suction portion 24, so that it is possible to enhance the backward moving efficiency.

It should be noted that by setting the angle θBL and the angle θBR to angles which are about 40 degrees or more and are about 50 degrees or less, setting the angle θAL and the angle θAR to angles which are about 25 degrees or more and are about 35 degrees or less, and setting the angle θCL and the angle θCR to angles which are about 25 degrees or more and are about 35 degrees or less, it becomes easy to apply the reverse bucket 40 to more types of hulls while enhancing the backward moving efficiency.

Moreover, from the viewpoint of making it difficult for the jet flows to hit the hull 11 and making it difficult for the jet flows to be sucked in again from the water suction portion 24, it may be designed so that the hull 11 and the water suction portion 24 are not provided on the extension of the direction of the jet flow FL and the extension of the direction of the jet flow FR (i.e., so that the hull 11 and the water suction portion 24 do not exist on the extension of the discharge direction of the water from the first outlet region 53L and the extension of the discharge direction of the water from the second outlet region 53R).

Next, a second preferred embodiment of the present invention will be described. Similar to FIG. 6, FIG. 8 is a front view of a reverse bucket 40 in the backward moving posture according to the second preferred embodiment of the present invention.

In the first preferred embodiment of the present invention, the reverse bucket 40 is configured to discharge the jet flows to both the left and right sides. On the other hand, in the second preferred embodiment of the present invention, as shown in FIG. 8, the reverse bucket 40, which is configured to discharge a jet flow to either the lower left front or the lower right front, is used. Moreover, by arranging a jet propulsion device 20, which includes a reverse bucket 40 to discharge the water to the left, and a jet propulsion device 20, which includes a reverse bucket 40 to discharge the water to the right, side by side on the left and the right of the stern, and providing one or more pairs of them, it is possible to smoothly perform steering and switching between forward moving and backward moving.

Figure 8:
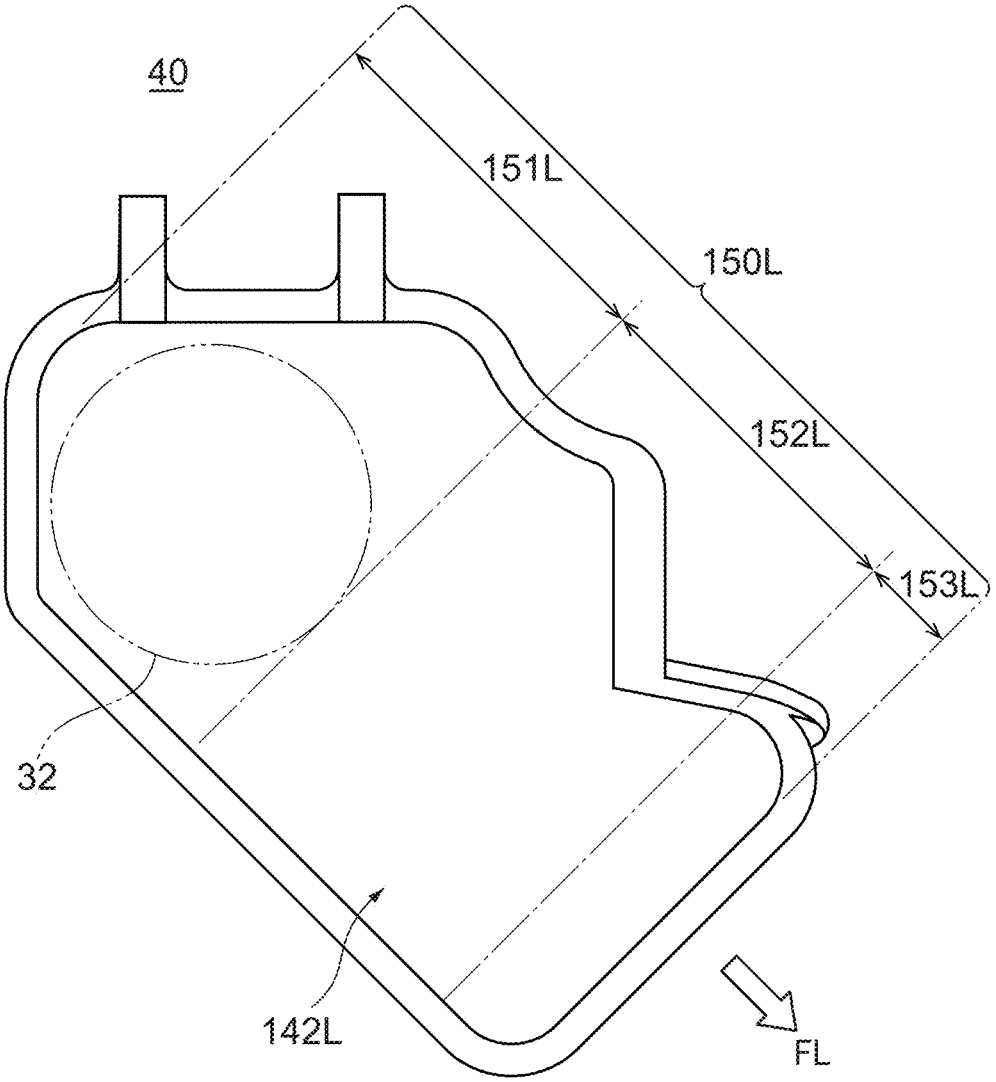
FIG. 8 is a front view of a reverse bucket in the backward moving posture according to a second preferred embodiment of the present invention.

FIG. 8 shows the reverse bucket 40 of a type that discharges a jet flow FL to the lower left front. Furthermore, although not shown, a reverse bucket 40 of a type that discharges a jet flow FR to the lower right front is configured to be bilaterally symmetrical to the reverse bucket 40 shown in FIG. 8 with respect to a virtual plane parallel to the front-rear direction and a virtual plane parallel to the vertical direction.

As shown in FIG. 8, the reverse bucket 40 includes a recess portion 150L. The recess portion 150L includes a continuous opening 142L. An inlet region 151L, a guide region 152L, and an outlet region 153L define the recess portion 150L. A discharge range 32 is a range in which the water is discharged from the discharge opening 31. The inlet region 151L is a main region that includes a region facing the discharge opening 31 in the backward moving posture and receives the discharged water from the discharge opening 31. The guide region 152L is a main region that guides the water received by the inlet region 151L to the outlet region 153L. The outlet region 153L is a main region that discharges the water guided by the guide region 152L to the outside. In the backward moving posture, the water is discharged from the outlet region 153L to the lower left front (the jet flow FL). Furthermore, although illustration is omitted, the water is discharged to the lower right front from an outlet region of the reverse bucket 40, which discharges the water to the right (the jet flow FR).

According to the second preferred embodiment of the present invention, it is possible to efficiently guide and discharge the water received from the discharge opening 31 of the deflector 30. Therefore, it is possible to enhance the backward moving performance of the marine vessel 10. In particular, by using one or more pairs of the reverse bucket 40 that discharges the jet flow FL to the lower left front and the reverse bucket 40 that discharges the jet flow FR to the lower right front, it is possible to obtain the same effect as in the first preferred embodiment in terms of enhancing the backward moving performance of the marine vessel 10.

Moreover, in each of the above-described preferred embodiments, the reverse bucket 40 is configured to be connected to the deflector 30 and rotate together with the deflector 30 leftward or rightward. However, the reverse bucket 40 is not limited to this configuration. For example, the reverse bucket 40 may be configured to be connected to the nozzle 21 so as to be freely rotatable vertically relative to the nozzle 21, and to not be movable in conjunction with the deflector 30.

Although the present invention has been described in detail based on the preferred embodiments described above, the present invention is not limited to these specific preferred embodiments, and various preferred embodiments within the scope not deviating from the gist of the present invention are also included in the present invention. Some of the above-described preferred embodiments may be combined as appropriate.

It should be noted that the present invention is also able to be applied to a saddle riding type personal watercraft (PWC) equipped with a saddle type seat or a standing riding type PWC.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A reverse bucket for a jet propulsion device comprising:

a vertical ridge line that faces a discharge opening of a deflector in a backward moving posture to make a marine vessel move backward;

a first inlet region and a second inlet region separated by the ridge line so that the first inlet region is positioned on a left side of the ridge line and the second inlet region is positioned on a right side of the ridge line, and face the discharge opening in the backward moving posture to receive water discharged from the discharge opening;

a first outlet region to discharge the water received by the first inlet region to outside the jet propulsion device;

a second outlet region to discharge the water received by the second inlet region to the outside of the jet propulsion device;

a first guide region to guide the water received by the first inlet region to the first outlet region; and a second guide region to guide the water received by the second inlet region to the second outlet region; wherein the first inlet region, the first guide region, and the first outlet region define a first recess portion;

the second inlet region, the second guide region, and the second outlet region define a second recess portion;

the first recess portion has a continuous concave curved surface over an entire region thereof and includes a first opening that opens a side of the first recess portion facing the discharge opening of the deflector in the backward moving posture; and the second recess portion has a continuous concave curved surface over an entire region thereof and includes a second opening that opens a side of the second recess portion facing the discharge opening of the deflector in the backward moving posture.

2. The reverse bucket according to claim 1, wherein, in the backward moving posture, the first outlet region discharges the water to the lower left front, and the second outlet region discharges the water to the lower right front.

3. The reverse bucket according to claim 1, wherein, in the backward moving posture, the ridge line is curved and recessed backward when viewed from a side of the jet propulsion device.

4. The reverse bucket according to claim 2, wherein, in the backward moving posture, both a discharge direction of the water from the first outlet region and a discharge direction of the water from the second outlet region are within an angle range of about 30 degrees to about 85 degrees below a horizontal plane when viewed from a rear of the jet propulsion device.

5. The reverse bucket according to claim 2, wherein, in the backward moving posture, both a discharge direction of the water from the first outlet region and a discharge direction of the water from the second outlet region are within an angle range of about 40 degrees to about 50 degrees below a horizontal plane when viewed from a rear of the jet propulsion device.

6. The reverse bucket according to claim 2, wherein, in the backward moving posture, both a discharge direction of the water from the first outlet region and a discharge direction of the water from the second outlet region are within an angle range of about 15 degrees to about 45 degrees below a horizontal plane when viewed from a side of the jet propulsion device.

7. The reverse bucket according to claim 2, wherein, in the backward moving posture, both a discharge direction of the water from the first outlet region and a discharge direction of the water from the second outlet region are within an angle range of about 25 degrees to about 35 degrees below a horizontal plane when viewed from a side of the jet propulsion device.

8. The reverse bucket according to claim 2, wherein, in the backward moving posture, both a discharge direction of the water from the first outlet region and a discharge direction of the water from the second outlet region are within an angle range of about 15 degrees to about 45 degrees in front of a virtual straight line in a front-rear direction when viewed from above the jet propulsion device.

9. The reverse bucket according to claim 2, wherein, in the backward moving posture, both a discharge direction of the water from the first outlet region and a discharge direction of the water from the second outlet region are within an angle range of about 25 degrees to about 35 degrees in front of a virtual straight line in a front-rear direction when viewed from above the jet propulsion device.

10. A reverse bucket for a jet propulsion device comprising:

an inlet region facing a discharge opening of a deflector in a backward moving posture to make a marine vessel move backward and to receive water discharged from the discharge opening;

an outlet region to discharge the water received by the inlet region to outside the jet propulsion device; and a guide region to guide the water received by the inlet region to the outlet region; wherein the inlet region, the guide region, and the outlet region define a recess portion including a continuous opening and having a continuous concave curved surface over an entire region thereof.

11. A jet propulsion device for a marine vessel comprising:

a deflector to rotate leftward or rightward; and a reverse bucket including:

a vertical ridge line that faces a discharge opening of the deflector in a backward moving posture to make the marine vessel move backward;

a first inlet region and a second inlet region separated by the ridge line so that the first inlet region is positioned on a left side of the ridge line and the second inlet region is positioned on a right side of the ridge line, and face the discharge opening in the backward moving posture to receive water discharged from the discharge opening;

a first outlet region to discharge the water received by the first inlet region to outside the jet propulsion device;

a second outlet region to discharge the water received by the second inlet region to the outside of the jet propulsion device;

a first guide region to guide the water received by the first inlet region to the first outlet region; and a second guide region to guide the water received by the second inlet region to the second outlet region; wherein the first inlet region, the first guide region, and the first outlet region define a first recess portion;

the second inlet region, the second guide region, and the second outlet region define a second recess portion;

the first recess portion has a continuous concave curved surface over an entire region thereof and includes a first opening that opens a side of the first recess portion facing the discharge opening of the deflector in the backward moving posture; and the second recess portion has a continuous concave curved surface over an entire region thereof and includes a second opening that opens a side of the second recess portion facing the discharge opening of the deflector in the backward moving posture.

12. The jet propulsion device according to claim 11, wherein the reverse bucket is connected to the deflector so as to be freely rotatable vertically with respect to the deflector.

13. The jet propulsion device according to claim 11, wherein, in the backward moving posture, the ridge line is curved and recessed backward when viewed from a side of the jet propulsion device.

14. The jet propulsion device according to claim 13, wherein, in the backward moving posture, a tip of the discharge opening of the deflector is curved so as to protrude backward when viewed from the side of the jet propulsion device.

15. A marine vessel comprising:

at least one jet propulsion device including:

a deflector to rotate leftward or rightward; and a reverse bucket including:

a vertical ridge line that faces a discharge opening of the deflector in a backward moving posture to make the marine vessel move backward;

a first inlet region and a second inlet region separated by the ridge line so that the first inlet region is positioned on a left side of the ridge line and the second inlet region is positioned on a right side of the ridge line, and face the discharge opening in the backward moving posture to receive water discharged from the discharge opening;

a first outlet region to discharge the water received by the first inlet region to outside of the jet propulsion device;

a second outlet region to discharge the water received by the second inlet region to the outside of the jet propulsion device;

a first guide region to guide the water received by the first inlet region to the first outlet region; and a second guide region to guide the water received by the second inlet region to the second outlet region; wherein the first inlet region, the first guide region, and the first outlet region define a first recess portion;

the second inlet region, the second guide region, and the second outlet region define a second recess portion;

the first recess portion has a continuous concave curved surface over an entire region thereof and includes a first opening that opens a side of the first recess portion facing the discharge opening of the deflector in the backward moving posture; and the second recess portion has a continuous concave curved surface over an entire region thereof and includes a second opening that opens a side of the second recess portion facing the discharge opening of the deflector in the backward moving posture.

16. The marine vessel according to claim 15, wherein the reverse bucket is connected to the deflector so as to be freely rotatable vertically with respect to the deflector.

* * * * *